United States Patent [19]

Parker

[11] 4,185,171

[45] Jan. 22, 1980

[54] COMPATIBLE SINGLE SIDEBAND SYSTEM FOR AM STEREO BROADCASTING

[75] Inventor: Norman W. Parker, Wheaton, Ill.

[73] Assignee: Motorola, Inc., Schaumburg, Ill.

[21] Appl. No.: 897,988

[22] Filed: Apr. 20, 1978

[51] Int. Cl.[2] ..... H04H 5/00

[52] U.S. Cl. ..... 179/1 GS; 325/61

[58] Field of Search ..... 179/1 GS; 325/36, 47, 325/61

[56] References Cited

U.S. PATENT DOCUMENTS

| | | | |
|---|---|---|---|
| 2,403,385 | 7/1946 | Loughlin | 179/1 GS |
| 3,068,475 | 12/1962 | Avins | 325/36 |
| 3,148,342 | 9/1964 | Holt | 179/1 GS |
| 3,218,393 | 11/1965 | Kahn | 325/36 |
| 3,908,090 | 9/1975 | Kahn | 179/1 GS |

*Primary Examiner*—Douglas W. Olms

*Attorney, Agent, or Firm*—Margaret Marsh Parker; James W. Gillman

[57] ABSTRACT

A system for the transmission and reception of two program signals L and R on a single channel by means of a compatible SSB AM stereophonic signal having the form $(1+L+R)\cos(\omega_c t+\phi)$ where $\phi$ is arc $\sin\{[(L-R)/\pi/2]\,[1+(L+R)/2]\,/\,(1+L+R)\}$. The system is also applicable to transmission of one program signal on one set of sidebands.

6 Claims, 2 Drawing Figures

COMPATIBLE SINGLE SIDEBAND SYSTEM FOR AM STEREO BROADCASTING

BACKGROUND OF THE INVENTION

The present invention relates to the field of AM stereophonic broadcasting and more particularly to a system for the transmission and reception of a carrier signal bearing information relating to one program signal on a first set of sidebands and, on a second set of sidebands, information relating to a second program signal.

Many systems have been devised for the transmission of two separate program signals on a single, amplitude-modulated carrier. For such a system to be compatible, i.e., to provide reception by a standard monophonic receiver with no added distortion, the receiver typically utilizing envelope detection, it is necessary that the envelope of the transmitted carrier contain only monophonic information, usually expressed as the sum signal (L+R). Therefore, the stereo separation information must be carried by the phase or frequency of the carrier. This variation or modulation of the carrier frequency or phase should be done without causing distortion in monophonic or stereophonic receivers and without degradation of either signal in S/N ratio. One method of doing this is to transmit on one set of sidebands the information necessary to decode the L signal, and on the other set of sidebands the information necessary to decode the R signal.

SUMMARY OF THE INVENTION

It is therefore an object of the present invention to provide a compatible system for transmitting and receiving a signal having amplitude variations proportional to the sum of the program signals and having information relating to one program signal on one set of sidebands and information relating to the other program signal on the other set of sidebands.

It is a particular object to provide a system adding no distortion to the envelope or to the stereophonic signal.

It is another object to provide a SSB system for transmitting and receiving one program signal using only one set of sidebands, which signal can be detected without distortion on a receiver employing envelope detection.

These objects and others are provided in a transmitter and receiver constructed in accordance with the present invention, the transmitter providing two carrier frequency components in quadrature, amplitude modulating one component with a signal 1+L+R and amplitude modulating the other with a signal $[(L-R)\angle\pi 2][1+(L+R)/2]$ the former component being separately modulated by a feedback signal to form an envelope correction signal. The three modulated components are combined additively and the combined signal is subsequently limited, then amplitude modulated by the sum signal L+R. The feedback signal is provided by detecting the envelope of the combined signal and by comparing that envelope with 1+L+R.

DETAILED DESCRIPTION OF THE PREFERRED EMBODIMENT

Figures 1, 2:
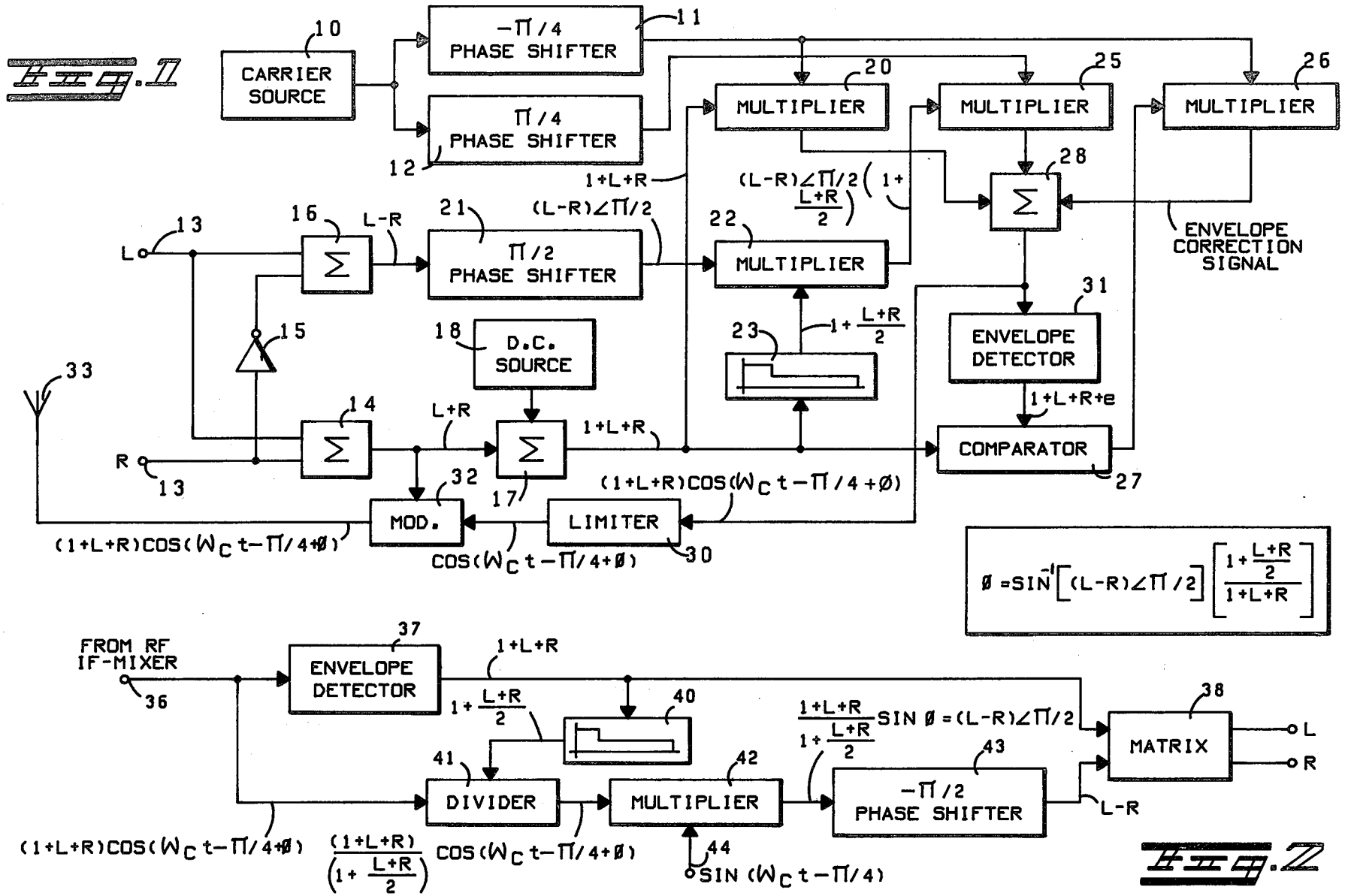
FIG. 1 of the drawing is a block diagram of a transmitter for providing a signal in accordance with the invention.
FIG. 2 is a block diagram of a receiver for receiving and decoding the signal of the transmitter in FIG. 1.

FIG. 1 shows in block diagram form a transmitter having a carrier source 10 for providing an RF signal of the frequency of the desired AM broadcast channel. The RF signal is then coupled to a pair of phase shifters which produce two carriers in quadrature. These may be, for example, a $-\pi/4$ phase shifter 11 and a $\pi/4$ phase shifter 12 but, in any case, the phase difference between the signals will be $\pi/2$ radians or 90°. Two independent program signals, which in the usual application are "left" and "right" information, are provided by two sources which may be microphones, recordings, etc. and are represented here as terminals 13L and 13R. These signals are combined additively in an adder 14 to form an L+R signal and, with an inverter 15 and an adder 16, to form an L−R signal. The L+R signal from the adder 13 is coupled to an adder 17 where it is combined with a DC signal from a DC source 18. The output signal from the adder 17 is thus 1+L+R where the "1" represents the unmodulated carrier signal level. The 1+L+R signal from the adder 17 coupled to a multiplier 20 to which the $-\pi/4$ phase-shifted carrier is coupled. The output of the multiplier 20 is thus $(1+L+R)\cos(\omega_c t-\pi/4)$.

The L−R signal from the adder 16 is coupled to a $\pi/2$ (90°) phase shifter 21, then coupled to a multiplier 22. The 1+L+R signal from the adder 17 is coupled through a two level bandpass filter 23 to the multiplier 22. The filter 23 has a bandpass characteristic for passing at least DC and for passing the audio frequency at a level ½ that of the DC output whereby the output signal of the filter 23 is 1+(L+R)/2. The output signal of the multiplier 22 is the product $[(L-R)\angle\pi/2][1+(L+R)/2]$ and this signal is coupled to a multiplier 25 where it is multiplied by the signal from the $\pi/4$ phase shifter 12 to provide an output signal $[(L-R)\angle\pi/2][1+(L+R)/2]\cos(\omega_c t+\pi/4)$.

The output of the $-\pi/4$ phase shifter 11 is coupled to another multiplier 26 as is a signal from a comparator 27 which will be described further below. The output signals of the multipliers 20, 25 and 26 are coupled to an adder 28 wherein the signals are combined to form a signal of the form $(1+L+R)\cos(\omega_c t-\pi/4+\phi)$. This combined signal is coupled to a limiter 30 to remove the amplitude variation, leaving a signal proportional to $\cos(\omega_c t-\pi/4+\phi)$ where $\phi$ is arc $\sin\{[(L-R)\angle\pi/2][1+(L+R)/2]/(1+L+R)\}$. The output signal from the adder 28 is also coupled to an envelope detector 31 to obtain a signal 1+L+R+e where "e" is an error signal. The detector output signal, which is proportional to the amplitude of the adder 28 output signal, is coupled to the comparator 27 as is the 1+L+R signal from the adder 17. Since the output signal of the envelope detector 31 will be essentially 1+L+R when the output signal of the adder 28 contains the desired phase information, the comparator 27 feeds back an amplified error signal to the multiplier 26 which, in turn, couples an envelope correction signal to the adder 28 which will force the amplitude of the adder 28 output signal to be 1+L+R. The envelope correction signal which is in phase with the output of the multiplier 20 is, added to the output signals of the multipliers 20 and 25, providing a signal out of the adder 28 having the desired amplitude and phase infor. ation. As mentioned above, this signal is limited in the limiter 30 and coupled to a high level modulator 32 where it is modulated by the L+R signal from the adder 13. The output signal at an antenna 33 is then a compatible SSB signal for the transmission of two AM stereo program signals. It should be noted here that this system is limited to a modulation factor of approximately 0.8 since at higher values sin $\phi$ can have a value greater than 1.0 which, of course, is not realizable.

To utilize the system of the invention for the transmission and reception of one program signal M on one set of sidebands (SSB), the signal M would be applied to the input of the phase shifter 21 and to the input of the adder 17. The adders 14 and 16 and inverter 15 would not be required, but the remaining elements of the transmitter would function as in FIG. 1. The transmitted signal would thus be $(1+M)\cos(\omega_c t-\pi/4+\phi)$ where $\phi=\text{arc sin}\,(M\angle\pi/2)(1+M/2)/(1+M)$ and the program signal M requires only one set of sidebands. If the transmitted signal were to be received on a stereo receiver of the type described hereinbelow with respect to FIG. 2, the signal M would appear at both of the matrix outputs. It would, of course, be preferable to receive the signal on a conventional SSB receiver.

In FIG. 2 is shown a receiver for receiving and demodulating signals broadcast by the transmitter of FIG. 1. The signal would be received on an antenna, and processed in an RF-IF-mixer stage (none of which are shown) which may be of any conventional design as long the bandwidth is sufficiently wide, producing a modified signal which is the counterpart of the received signal on an intermediate frequency. The output signal of the IF is processed in an envelope detector 37, producing a 1+L+R output signal which is coupled to a matrix 38 which will be discussed further hereinbelow. The envelope detector output signal is also coupled to a filter 40 having a characteristic similar to that of the filter 23 of the transmitter of FIG. 1. The output signal of the filter 40 is likewise $1+(L+R)/2$, and this signal is coupled to divider 41. In the divider 41 the IF output signal is divided by the filter 40 output signal to provide a divider output signal $(1+L+R)[1+(L+R)/2]\cos(\omega_c t-\pi/4+\phi)$ where $\phi$ is as given above. This signal is coupled to a multiplier 42 where it is multiplied by a $\sin(\omega_c t-\pi/4)$ signal from a terminal 43. The sin $(\omega_c t-\pi/4)$ signal may be supplied by a phase locked loop (not shown) or a similar source. The product signal from the multiplier 42 is $[1+L+R)\sin\phi]/[1+(L+R)/2]$ which, it may be seen, equals $(L-R)\angle\pi/2$. The multiplier output signal is processed in a $-\pi/2$ phase shifter 43 to provide an L−R signal which is coupled to the matrix 38. The output signals of the matrix are then L and R.

Thus there has been shown and described a system with transmitter and receiver for utilizing a signal of the form $(1+L+R)\cos(\omega_c t-\pi/4+\phi)$ where $\phi$ is arc sin $\{[(L-R)\angle\pi/2][1+(L+R)/2]/(1+L+R)\}$. Other variations and modifications of the preferred embodiment are possible and is intended to cover all such as fall within the spirit and scope of the appended claims.

What is claimed is:

1. A transmitter for transmitting a signal of the form $(1+L+R)\cos\sin(\omega_c t-\pi/4+\phi)$ where $\phi$ is arc sin $\{[(L-R)\angle\theta][1+(L+R)/2\angle\beta]/[1+(L+R)\angle\beta]\}$, where L and R are program signals and $\theta$ and $\beta$ have a 90° phase difference therebetween, the transmitter comprising in combination:

first and second program signal sources for providing signals proportional to L and R respectively;

a carrier frequency source;

first phase shifter means for deriving from the carrier frequency signal two signal components having a phase difference of $\pi/2$ radians therebetween;

first combining means coupled to the first and second program signal sources for providing sum (L+R) and difference (L−R) signals;

second phase shifter means coupled to shift the phase of the difference signal by $\pi/2$ radians;

a DC source for providing a signal proportional to the unmodulated carrier level;

second combining means for adding the DC carrier level signal to the sum signal;

filter means coupled to receive the output signal of the second combining means and having a pass band for reducing the amplitude of the audio portion of the output signal thereof to substantially ½ with respect to a band of frequencies lower than audio frequencies and including DC;

first multiplier means for multiplying the output signal from the filter means by the output signal of the second phase shifter means;

second multiplier means for multiplying a first one of the phase shifted carrier frequency signals by the output signal of the second combining means;

third multiplier means for multiplying the other of the carrier frequency signals by the output signal of the first multiplier means;

third combining means for combining the output signals of the second and third multiplier means;

detector means coupled to detect the amplitude modulation on the output signal of the third combining means;

comparator means coupled to compare the output signals of the second combining means and the detector means;

forth multiplier means for multiplying the first one of the carrier frequency signals by the output signal of the comparator means, the output signal of the fourth multiplier means also being coupled to the third combining means for being combined with the output signals of the second and third multiplier means;

limiter means coupled to limit the amplitude of the output signal of the third combining means; and modulator means for amplitude modulating the output signal of the limiter means with the sum signal from the first combining means.

2. A transmitter in accordance with claim 1 wherein the first combining means includes at least two adder means and one inverter means.

3. A transmitter in accordance with claim 1 and wherein $\theta$ is 90° and $\beta$ is 0°.

4. A transmitter for transmitting a signal of the form $(1+M)\cos(\omega_c t+\phi)$ where $\phi$ is arc sin $\{[M\angle\theta][1+M/2\angle\beta]/[1+M\angle\beta]\}$, where M is a program signal and $\theta$ and $\beta$ have a 90° phase difference therebetween, the transmitter comprising in combination:

a program signal source for providing a signal proportional to M;

a carrier frequency source;

first phase shifter means for deriving from the carrier frequency two components having a phase difference of $\pi/2$ radians therebetween;

first and second input terminals for receiving the program signal;

second phase shifter means coupled to the first input terminal to shift the phase of the program signal by $\pi/2$ radians;

a DC source for providing a signal proportional to the unmodulated carrier level;

first combining means coupled to the second input terminal for adding the DC carrier level signal to the program signal;

filter means coupled to receive the output signal of the first combining means and having a pass band for reducing the amplitude of the audio portion of the output signal thereof to substantially $\frac{1}{2}$ with respect to a band of frequencies lower than audio frequencies and including DC;

first multiplier means for multiplying the output signal from the filter means by the output signal of the second phase shifter means;

second multiplier means for multiplying the carrier frequency signal by the output signal of the first combining means;

third multiplier means for multiplying the carrier frequency signal by the output signal of the first multiplier means;

second combining means for combining the output signals of the second and third multiplier means;

detector means coupled to detect the amplitude modulation on the output signal of the second combining means;

comparator means coupled to compare the output signals of the first combining means and the detector means;

fourth multiplier means for multiplying the carrier frequency signal by the output signal of the comparator means;

limiter means coupled to limit the amplitude of the output signal of the second combining means; and modulator means for amplitude modulating the output signal of the limiter means with the program signal.

5. A transmitter in accordance with claim 4 wherein $\theta$ is 90° and $\beta$ is 0°.

6. A receiver for receiving a signal of the form $(1+L+R)\cos(\omega_c t+\phi)$ where $\phi$ is arc sin $\{[(L-R)\angle\pi/2][1+(L+R)/2]/(1+L+R]\}$, and comprising in combination:

input means for providing a modified signal which is related to the received signal and includes an intermediate frequency carrier;

detector means for providing a signal proportional to the amplitude modulation on the modified signal;

filter means coupled to receive the output signal of the detector means, the filter means having a pass band for reducing the amplitude of the audio portion of the detector output signal to substantially one-half with respect to a band of frequencies lower than audio frequencies and including D.C.;

divider means for dividing the output signal of the input means by the output signal of the filter means;

oscillator means for supplying an unmodulated signal having the frequency of the intermediate frequency carrier and having a 90° phase difference from the unmodulated intermediate frequency carrier;

multiplier means for multiplying the output signal of the divider means by the signal from the oscillator means;

phase shifter means for shifting the phase of the multiplier means output signal to the phase of the detector means output signal; and matrixing means for processing the output signals of the detector means and the phase shifter means to provide signals proportional to L and R.

* * * * *